US008851413B2

(12) United States Patent
Phillips et al.

(10) Patent No.: US 8,851,413 B2
(45) Date of Patent: Oct. 7, 2014

(54) REEL ASSEMBLY

(71) Applicant: Suncast Technologies, LLC, Palm Beach Gardens, FL (US)

(72) Inventors: William Phillips, Batavia, IL (US); Michael Uffner, Naperville, IL (US); Michael Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 194 days.

(21) Appl. No.: 13/667,766

(22) Filed: Nov. 2, 2012

(65) Prior Publication Data

US 2014/0124611 A1 May 8, 2014

(51) Int. Cl.
*B65H 75/22* (2006.01)

(52) U.S. Cl.
USPC ..... 242/609.1; 242/608.6; 242/613.4; 242/614.1; 242/118.6

(58) Field of Classification Search
CPC ..... B65H 75/14; B65H 75/145; B65H 75/22; B65H 2701/33–2701/333
USPC ..... 242/607, 608, 608.2, 608.6, 608.7, 242/609–609.4, 613, 613.4, 614, 614.1, 242/118.4, 118.6, 118.61
See application file for complete search history.

(56) References Cited

U.S. PATENT DOCUMENTS

| | | | |
|---|---|---|---|
| 21,622 | A | 9/1858 | McLean |
| 177,367 | A | 5/1876 | Bartlett |
| 215,646 | A | 5/1879 | McKeever |
| 226,012 | A | 3/1880 | Aiken |
| 231,898 | A | 9/1880 | Carroll |
| 238,153 | A | 2/1881 | Piper |
| 270,049 | A | 1/1883 | Fraikin |
| 706,968 | A | 8/1902 | Le Mond |
| 848,239 | A | 3/1907 | Grimsrud |
| 904,380 | A | 11/1908 | Vader |
| 1,001,383 | A | 8/1911 | Geer et al. |
| 1,115,325 | A | 10/1914 | McCall |
| 1,227,466 | A | 5/1917 | McDowell |
| 1,441,157 | A | 1/1923 | Krenke |
| 1,449,644 | A | 3/1923 | White |
| D63,106 | S | 10/1923 | Krisher |
| 1,489,664 | A | 4/1924 | Dowrelio |
| 1,532,177 | A | 4/1925 | Gist |

(Continued)

FOREIGN PATENT DOCUMENTS

| | | |
|---|---|---|
| GB | 246395 | 1/1926 |
| GB | 1029821 | 2/1963 |

(Continued)

*Primary Examiner* — William E Dondero
(74) *Attorney, Agent, or Firm* — McHale & Slavin, P.A.

(57) ABSTRACT

An improved reel assembly comprised of two identically molded semi-circular core halves having a pair of reel flanges on each end thereof that requires no fasteners. The core halves and reel flanges are constructed and arranged to connect without the need for fasteners to form an improved reel assembly for receipt of a flexible hose. The halves include a plurality of radially extending cross-braces having a conical cross-section. On opposite ends of each half is included a pair of radially extending tubular members having a hollow body and conical cross-section. Each half has opposite reciprocating cross-braces that interlock, as well as opposite reciprocating tubular members that insert within each other to create a strong connection between the halves. The improved reel assembly creates a stronger reel core structure that resists crushing of the reel and separation between the reel halves from a pressurized hose wound thereon.

14 Claims, 8 Drawing Sheets

(56) References Cited

U.S. PATENT DOCUMENTS

| | | | |
|---|---|---|---|
| 1,537,637 | A | 5/1925 | Jarvis |
| 1,612,206 | A | 12/1926 | Nicholson |
| 1,653,103 | A | 12/1927 | Keys |
| 1,761,453 | A | 6/1930 | Rankin |
| 1,851,076 | A | 3/1932 | Ackerman |
| 1,875,467 | A | 9/1932 | Knoerzer et al. |
| 1,901,660 | A | 3/1933 | Lund |
| 1,914,654 | A | 6/1933 | Tornblow |
| 1,933,163 | A | 10/1933 | Coplen |
| 2,023,611 | A | 12/1935 | Neuman |
| 2,089,547 | A | 8/1937 | Folliot |
| 2,095,653 | A | 10/1937 | Tepel |
| 2,155,769 | A | 4/1939 | Porter |
| D128,377 | S | 7/1941 | Horn |
| 2,257,837 | A | 10/1941 | Burge et al. |
| 2,283,626 | A | 5/1942 | Freydberg |
| 2,301,208 | A | 11/1942 | Gear |
| 2,312,528 | A | 3/1943 | Davis |
| 2,512,756 | A | 6/1950 | Wasserman |
| 2,547,826 | A | 4/1951 | Kirschner |
| 2,573,868 | A | 11/1951 | Newell |
| 2,595,655 | A | 5/1952 | Hannay |
| RE23,510 | E | 6/1952 | Jahoda |
| 2,606,067 | A | 8/1952 | Roarke |
| 2,608,360 | A | 8/1952 | Cootware |
| 2,609,231 | A | 9/1952 | Crawford |
| 2,629,630 | A | 2/1953 | Rourke |
| 2,640,724 | A | 6/1953 | Sanders et al. |
| 2,642,312 | A | 6/1953 | Shine |
| 2,659,546 | A | 11/1953 | Rotter et al. |
| 2,755,035 | A | 7/1956 | Moulder |
| 2,774,609 | A | 12/1956 | Winger |
| 2,779,642 | A | 1/1957 | Matthews |
| 2,823,074 | A | 2/1958 | Bernard, Jr. |
| 2,871,057 | A | 1/1959 | Bernyk |
| 2,884,496 | A | 4/1959 | Rhodes et al. |
| 2,893,250 | A | 7/1959 | Moore |
| 2,893,656 | A | 7/1959 | Carlson |
| 2,902,161 | A | 9/1959 | Humbert, Jr. et al. |
| 2,918,975 | A | 12/1959 | Conery et al. |
| 2,963,227 | A | 12/1960 | Lambert |
| 3,050,078 | A | 8/1962 | Hooper |
| 3,051,189 | A | 8/1962 | Pro |
| 3,110,453 | A | 11/1963 | Becker et al. |
| 3,118,685 | A | 1/1964 | Jordan |
| 3,139,192 | A | 6/1964 | Maguire |
| 3,144,041 | A | 8/1964 | Werner et al. |
| 3,156,282 | A | 11/1964 | Bedford, Jr. |
| 3,195,735 | A | 7/1965 | Jay |
| 3,315,914 | A | 4/1967 | Turner |
| 3,380,097 | A | 4/1968 | Pharris |
| D211,531 | S | 6/1968 | Elmslie |
| 3,388,716 | A | 6/1968 | Wilson |
| 3,399,911 | A | 9/1968 | Reisch |
| 3,407,836 | A | 10/1968 | Keiser |
| 3,433,247 | A | 3/1969 | Haselden |
| 3,522,888 | A | 8/1970 | Grams et al. |
| D218,700 | S | 9/1970 | Levin |
| 3,587,626 | A | 6/1971 | Cowley et al. |
| 3,625,450 | A | 12/1971 | Lloyd, Jr. |
| 3,721,349 | A | 3/1973 | Jaffee et al. |
| 3,752,553 | A | 8/1973 | Bildahl et al. |
| 3,781,738 | A | 12/1973 | Rozelle |
| 3,844,000 | A | 10/1974 | Hedu |
| 3,868,123 | A | 2/1975 | Berg et al. |
| 3,898,784 | A | 8/1975 | Sauer et al. |
| 3,910,524 | A | 10/1975 | Ireland |
| 3,936,026 | A | 2/1976 | Hampel et al. |
| 3,977,429 | A | 8/1976 | Stevenson |
| 3,995,487 | A | 12/1976 | Locke |
| 4,012,002 | A | 3/1977 | McDonald et al. |
| 4,019,298 | A | 4/1977 | Johnson, IV |
| 4,033,552 | A | 7/1977 | Kuzarov |
| 4,041,974 | A | 8/1977 | Keiser |
| 4,043,278 | A | 8/1977 | Kessler et al. |
| 4,068,599 | A | 1/1978 | Sapp et al. |
| D248,549 | S | 7/1978 | Lopez |
| 4,108,562 | A | 8/1978 | Collard et al. |
| 4,125,338 | A | 11/1978 | Lew |
| 4,131,381 | A | 12/1978 | Alberts |
| 4,135,837 | A | 1/1979 | Suttles |
| 4,137,939 | A | 2/1979 | Chow |
| 4,224,960 | A | 9/1980 | Nederman |
| 4,227,661 | A | 10/1980 | King et al. |
| 4,238,074 | A | 12/1980 | Coons |
| 4,272,037 | A | 6/1981 | Becker et al. |
| D260,134 | S | 8/1981 | Bercu |
| 4,315,522 | A | 2/1982 | Brown |
| 4,330,005 | A | 5/1982 | Kjarsgaard |
| 4,369,553 | A | 1/1983 | Yuda |
| 4,382,518 | A | 5/1983 | Bondoux |
| 4,401,287 | A | 8/1983 | Moeser |
| 4,431,144 | A | 2/1984 | Foster |
| 4,444,435 | A | 4/1984 | Honsa |
| D275,552 | S | 9/1984 | Izumi |
| 4,506,698 | A | 3/1985 | Garcia et al. |
| 4,512,361 | A | 4/1985 | Tisbo et al. |
| 4,513,772 | A | 4/1985 | Fisher |
| 4,536,904 | A | 8/1985 | Whitehead |
| 4,537,215 | A | 8/1985 | Roman |
| 4,540,017 | A | 9/1985 | Prange |
| 4,586,676 | A | 5/1986 | Johnston et al. |
| 4,595,107 | A | 6/1986 | Welsch |
| D285,901 | S | 9/1986 | Gustavsson |
| D286,503 | S | 11/1986 | Bobrovniczky |
| 4,633,549 | A | 1/1987 | Lovato |
| 4,637,749 | A | 1/1987 | Jones et al. |
| 4,640,486 | A | 2/1987 | Neville |
| D288,773 | S | 3/1987 | Ward |
| D289,492 | S | 4/1987 | Clivio et al. |
| 4,659,050 | A | 4/1987 | Tabayashi |
| RE32,510 | E | 9/1987 | Tisbo et al. |
| 4,689,929 | A | 9/1987 | Wright |
| 4,697,778 | A | 10/1987 | Harashima |
| 4,700,737 | A | 10/1987 | Nelson |
| 4,705,423 | A | 11/1987 | Smith |
| 4,713,865 | A | 12/1987 | Geldwerth |
| D294,455 | S | 3/1988 | Nelson |
| 4,729,484 | A | 3/1988 | McConnell |
| 4,743,040 | A | 5/1988 | Breveglieri et al. |
| 4,757,838 | A | 7/1988 | McGullion |
| 4,763,799 | A | 8/1988 | Cohn et al. |
| 4,767,073 | A | 8/1988 | Malzacher |
| 4,768,546 | A | 9/1988 | Brusadin et al. |
| 4,777,976 | A | 10/1988 | Johnston et al. |
| 4,793,376 | A | 12/1988 | Hare |
| D299,801 | S | 2/1989 | Basitodos |
| 4,824,137 | A | 4/1989 | Bolden |
| 4,832,074 | A | 5/1989 | Li |
| 4,838,302 | A | 6/1989 | Prange |
| D303,446 | S | 9/1989 | Kitts et al. |
| 4,893,037 | A | 1/1990 | Schwartz |
| 4,897,512 | A | 1/1990 | Johnston |
| 4,913,580 | A | 4/1990 | Whitehead |
| 4,946,127 | A | 8/1990 | Kulaga |
| 4,974,627 | A | 12/1990 | Nelson |
| 5,000,513 | A | 3/1991 | Schmidt |
| 5,007,598 | A | 4/1991 | Spear et al. |
| 5,011,034 | A | 4/1991 | Abel |
| 5,014,925 | A | 5/1991 | Cump |
| 5,023,410 | A | 6/1991 | Danielson et al. |
| 5,046,520 | A | 9/1991 | Sanchez, Jr. et al. |
| D321,123 | S | 10/1991 | Simonetti |
| 5,056,553 | A | 10/1991 | Whitehead et al. |
| D323,228 | S | 1/1992 | Spear et al. |
| 5,080,322 | A | 1/1992 | Harley |
| 5,083,805 | A | 1/1992 | Monch et al. |
| D323,916 | S | 2/1992 | Sanchez, Jr. et al. |
| 5,109,882 | A | 5/1992 | Eley |
| D327,637 | S | 7/1992 | Sanchez |
| D328,173 | S | 7/1992 | Nelson |

(56) References Cited

U.S. PATENT DOCUMENTS

| | | | |
|---|---|---|---|
| 5,179,972 | A | 1/1993 | Eley |
| 5,205,521 | A | 4/1993 | Smith |
| 5,207,723 | A | 5/1993 | Newby, Sr. |
| 5,213,351 | A | 5/1993 | Chen |
| D336,708 | S | 6/1993 | Boughey |
| D341,770 | S | 11/1993 | Spear et al. |
| 5,318,315 | A | 6/1994 | White et al. |
| D349,039 | S | 7/1994 | Goodman et al. |
| 5,330,121 | A | 7/1994 | Eley |
| 5,335,687 | A | 8/1994 | Odom |
| D351,333 | S | 10/1994 | Nelson et al. |
| D352,149 | S | 11/1994 | Nelson et al. |
| D352,232 | S | 11/1994 | Apgar |
| D352,449 | S | 11/1994 | Rosine |
| D354,186 | S | 1/1995 | Grosfillex |
| D355,515 | S | 2/1995 | Spear et al. |
| D355,584 | S | 2/1995 | Clivio |
| 5,388,609 | A | 2/1995 | Ghio et al. |
| 5,390,695 | A | 2/1995 | Howard |
| D357,600 | S | 4/1995 | Chen |
| 5,404,900 | A | 4/1995 | Fletchall |
| 5,425,391 | A | 6/1995 | Tisbo et al. |
| 5,427,394 | A | 6/1995 | Lauto |
| D361,420 | S | 8/1995 | Riek |
| D363,207 | S | 10/1995 | Tisbo et al. |
| 5,462,298 | A | 10/1995 | Bodine |
| 5,495,995 | A | 3/1996 | Dominique et al. |
| 5,526,842 | A | 6/1996 | Christensen |
| 5,560,391 | A | 10/1996 | Bantaculo |
| 5,566,961 | A | 10/1996 | Snell et al. |
| 5,568,824 | A | 10/1996 | Cordrey |
| D376,096 | S | 12/1996 | Tisbo et al. |
| 5,587,569 | A | 12/1996 | Mohtasham |
| 5,605,344 | A | 2/1997 | Insalaco et al. |
| 5,615,903 | A | 4/1997 | Spear et al. |
| 5,657,789 | A | 8/1997 | Tisbo et al. |
| 5,676,402 | A | 10/1997 | Eley et al. |
| 5,678,596 | A | 10/1997 | Corallo |
| 5,678,599 | A | 10/1997 | Moss |
| D387,531 | S | 12/1997 | Tisbo et al. |
| 5,704,384 | A | 1/1998 | Tisbo et al. |
| D390,315 | S | 2/1998 | Spear et al. |
| D390,449 | S | 2/1998 | Whitehead et al. |
| 5,741,188 | A | 4/1998 | Levin et al. |
| 5,758,685 | A | 6/1998 | Tisbo et al. |
| 5,779,309 | A | 7/1998 | Lu |
| 5,782,451 | A | 7/1998 | Carahan et al. |
| 5,794,649 | A | 8/1998 | Spear et al. |
| 5,797,424 | A | 8/1998 | Tisbo et al. |
| 5,887,878 | A | 3/1999 | Tisbo et al. |
| 5,895,093 | A | 4/1999 | Casey et al. |
| 5,897,430 | A | 4/1999 | Haller |
| D409,813 | S | 5/1999 | Tisbo et al. |
| 5,901,730 | A | 5/1999 | Tisbo et al. |
| 5,988,552 | A | 11/1999 | Tisbo et al. |
| D417,538 | S | 12/1999 | Tisbo et al. |
| D418,270 | S | 12/1999 | Tisbo et al. |
| 5,998,552 | A | 12/1999 | Gruber et al. |
| D418,739 | S | 1/2000 | Whitehead et al. |
| 6,050,290 | A | 4/2000 | Yacobi et al. |
| 6,050,291 | A | 4/2000 | Whitehead et al. |
| 6,086,073 | A | 7/2000 | Tisbo et al. |
| 6,089,520 | A | 7/2000 | Wu et al. |
| D429,418 | S | 8/2000 | Tisbo et al. |
| D432,002 | S | 10/2000 | Anderson et al. |
| 6,149,096 | A | 11/2000 | Hartley |
| D448,652 | S | 10/2001 | Spear et al. |
| D449,914 | S | 10/2001 | Spear et al. |
| RE37,442 | E | 11/2001 | Spear et al. |
| 6,338,360 | B2 | 1/2002 | Spear et al. |
| 6,386,473 | B1 | 5/2002 | Vitaletti |
| D460,343 | S | 7/2002 | Spear et al. |
| D462,851 | S | 9/2002 | Montalbano |
| D463,147 | S | 9/2002 | Montalbano |
| 6,467,499 | B1 | 10/2002 | Smith |
| 6,478,265 | B2 | 11/2002 | Leach |
| 6,533,210 | B1 | 3/2003 | Berke et al. |
| 6,546,953 | B1 | 4/2003 | Kowalke |
| 6,591,858 | B2 | 7/2003 | Peterson |
| D478,803 | S | 8/2003 | Markley |
| 6,637,454 | B1 | 10/2003 | Eley |
| 6,669,135 | B1 | 12/2003 | Hartley |
| 6,672,329 | B1 | 1/2004 | Brooks et al. |
| 6,742,740 | B2 | 6/2004 | Tisbo et al. |
| 6,752,342 | B1 | 6/2004 | Nagler |
| 6,807,982 | B1 | 10/2004 | Ames |
| 6,834,670 | B2 | 12/2004 | Rosine et al. |
| D501,788 | S | 2/2005 | Richardson et al. |
| 6,877,687 | B2 | 4/2005 | Moon et al. |
| D506,123 | S | 6/2005 | English et al. |
| 6,908,058 | B2 | 6/2005 | Moon et al. |
| 6,913,221 | B2 | 7/2005 | Moon et al. |
| 6,976,649 | B2 | 12/2005 | Tisbo et al. |
| 6,979,649 | B2 | 12/2005 | Arai et al. |
| 6,981,483 | B1 | 1/2006 | Keip |
| 7,017,603 | B1 | 3/2006 | Rosine et al. |
| 7,028,968 | B2 | 4/2006 | Washick |
| 7,032,811 | B1 | 4/2006 | Paulic et al. |
| D530,875 | S | 10/2006 | Rosine et al. |
| 7,216,666 | B2 | 5/2007 | Levy et al. |
| D544,307 | S | 6/2007 | Albo |
| D551,061 | S | 9/2007 | English et al. |
| D554,479 | S | 11/2007 | Rosine et al. |
| 7,316,368 | B2 | 1/2008 | Moon et al. |
| D561,010 | S | 2/2008 | Anderson et al. |
| 7,360,748 | B2 | 4/2008 | Rosine et al. |
| 7,377,289 | B1 | 5/2008 | English et al. |
| D575,025 | S | 8/2008 | Anderson et al. |
| 7,438,250 | B2 | 10/2008 | Anderson et al. |
| D580,621 | S | 11/2008 | Anderson et al. |
| D582,756 | S | 12/2008 | Anderson et al. |
| D582,757 | S | 12/2008 | Anderson et al. |
| D582,758 | S | 12/2008 | Anderson et al. |
| D582,759 | S | 12/2008 | Anderson et al. |
| 7,559,501 | B2 | 7/2009 | Jian |
| 7,575,188 | B2 | 8/2009 | Mullen et al. |
| 7,581,705 | B2 | 9/2009 | Rosine et al. |
| D605,375 | S | 12/2009 | Anderson et al. |
| 7,658,358 | B2 | 2/2010 | Rosine et al. |
| D623,503 | S | 9/2010 | Hatcher et al. |
| 7,810,751 | B2 | 10/2010 | Caamano et al. |
| D635,448 | S | 4/2011 | Thuma et al. |
| D636,253 | S | 4/2011 | Hatcher et al. |
| 7,959,101 | B2 | 6/2011 | Whitehead et al. |
| 8,082,944 | B2 | 12/2011 | Rosine et al. |
| 8,096,317 | B2 | 1/2012 | Uffner et al. |
| D661,571 | S | 6/2012 | Vogler et al. |
| D661,977 | S | 6/2012 | Donnelly et al. |
| D667,292 | S | 9/2012 | Donnelly et al. |
| D669,765 | S | 10/2012 | Donnelly et al. |
| D672,634 | S | 12/2012 | Phillips et al. |
| D672,635 | S | 12/2012 | Phillips et al. |
| D673,030 | S | 12/2012 | Phillips et al. |
| 2002/0014551 | A1 | 2/2002 | Tuttlebee |
| 2003/0034417 | A1 | 2/2003 | Tisbo et al. |
| 2003/0098067 | A1 | 5/2003 | Peterson |
| 2003/0234312 | A1 | 12/2003 | Kuo |
| 2004/0046078 | A1 | 3/2004 | Moon et al. |
| 2004/0178314 | A1 | 9/2004 | Chen et al. |
| 2004/0188558 | A1 | 9/2004 | Moon et al. |
| 2005/0017117 | A1 | 1/2005 | Moon et al. |
| 2005/0211857 | A1 | 9/2005 | Bolinder et al. |

(56) References Cited

U.S. PATENT DOCUMENTS

| | | | |
|---|---|---|---|
| 2006/0045733 | A1 | 3/2006 | Nagler |
| 2006/0054731 | A1 | 3/2006 | Nagler |
| 2006/0054770 | A1 | 3/2006 | Lansdown |
| 2007/0018026 | A1 | 1/2007 | Uffner et al. |
| 2007/0114319 | A1 | 5/2007 | Anderson et al. |
| 2007/0125778 | A1 | 6/2007 | Uffner et al. |
| 2007/0241224 | A1 | 10/2007 | Nagler |
| 2008/0295894 | A1 | 12/2008 | Uffner et al. |
| 2009/0121067 | A1 | 5/2009 | Arcati et al. |
| 2009/0151484 | A1 | 6/2009 | Mullen et al. |
| 2010/0155520 | A1 | 6/2010 | Whitehead et al. |
| 2011/0030812 | A1 | 2/2011 | McKimmy et al. |
| 2012/0204972 | A1 | 8/2012 | Phillips et al. |
| 2012/0291882 | A1 | 11/2012 | Vogler et al. |
| 2013/0056094 | A1 | 3/2013 | Phillips et al. |

FOREIGN PATENT DOCUMENTS

| | | |
|---|---|---|
| GB | 1127848 | 9/1968 |
| GB | 1278928 | 6/1972 |
| GB | 1315842 | 5/1973 |
| GB | 1361417 | 7/1974 |
| GB | 1378032 | 12/1974 |
| GB | 2207097 | 1/1989 |
| GB | 2247650 | 3/1992 |
| GB | 2283945 | 5/1995 |
| GB | 2290056 | 12/1995 |

REEL ASSEMBLY

FIELD OF THE INVENTION

The present invention relates to a reel assembly, more specifically, an improved reel assembly having a strong connection between reel flanges and reel cross braces to further resist crushing and separation from a pressurized hose wound onto the reel.

BACKGROUND OF THE INVENTION

Leaving a flexible garden hose from as short as 25 feet to as long as perhaps 200 feet in a randomly coiled or uncoiled tangled mass on the ground or within an enclosure of some type can only be counter productive and even dangerous to the user or others, but can also be a cause of needless deterioration of the hose itself. Garden hoses left lying on the ground can be damaged from tearing or crushing when they come in contact with a variety of wheeled vehicles. If left lying on the ground, they may also be subjected to contamination by fertilizers or garden chemicals. Damage from twisting, kinking, or curling may easily result from random storage placement as well.

A simple solution to this condition is to place the hose on a reel assembly which allows it to be maintained in a productive, protective position when not in use, and perhaps even more importantly, when actually in use. The hose can be extended, retracted, and stored in a manner that eliminates the risk of damage to the hose. The reel may be attached to a stationary assembly or on a wheeled assembly that allows the user to place the hose in random locations during use and storage when in not in use.

The reel assembly saves time in deployment of and retracting the hose, thereby allowing for more productive use. The operation of the hose reel is a relatively simple process that any operator will quickly master. Correctly winding the hose onto the reel will determine how well the hose reel performs, improper winding will cause binding in the reel, making it difficult to release the hose.

The reel is the object about which lengths of hose are wound thereabout for storage. Generally, a reel is a cylindrical core having flanges on the sides to retain the hose wound around the core. Typically, a reel is made of metal, fiberglass, or plastic. One factor to consider in selecting a reel assembly is the reel construction. The reel construction needs to be substantial enough to provide both strength and durability. For this reason, many hose reels are constructed of plastic because the resulting product resists crushing as well as withstands harsh environmental conditions. Additionally, it is important to choose the correct reel design for the application being used. Hose reels are categorized by the diameter and length of the hose they hold, the rewind method, and the pressure rating. The size of the core is dependent on several factors. A smaller core will allow a longer hose to be stored in a given reel. However, there is a limit to how tightly the hose can be wound without damaging the hose, and this limits how small the core can be.

When water is introduced into the hose, the water creates and maintains pressure throughout the hose causing the hose to expand. Should any of the hose be left on the hose reel during this spike in pressure, the hose will exert a tremendous amount of pressure onto the reel and potentially compromise its integrity. Occasionally, a "python" effect occurs on a neatly wound hose on the reel. When the neatly wound hose on the reel is pressurized as a result of the introduction of water, it causes each wound segment of the hose to exert pressure on its adjoining segments. This compounding of hose pressure can lead to tremendous forces exerted inwardly to the center core of the reel, and outwardly upon the end flanges of the reel which can eventually lead to the destruction of the reel. Introducing support members and or cross-braces within the core of the reel to increase the mechanical strength of the reel will help resist crushing.

Another factor to consider in selecting a reel assembly is maintenance. Typically, a reel assembly requires the consumer to disassemble the reel in order to clean and replace parts. However, procedures that are challenging or require extended amounts of time can result in poor or improper maintenance of the reel assembly. Requiring tools for assembly can be time consuming and frustrating for the consumer and can lead to a damaged reel if the assembly is done improperly. Damage can occur when the consumer fails to either follow instructions, tries to force fit a component, or doesn't have the proper tools required for assembly. The result is aggravation to the consumer.

Thus, what is lacking in the art is a reel assembly that requires no fasteners, can be unassembled and reassembled easily for maintenance, and has a stronger connection geometry between reel flanges and reel cross-braces. This structure creates a stronger reel core configuration that resists crushing of the reel or separation between the reel halves and stronger connection between the reel halves and the reel end flanges that can result from a pressurized hose wound thereon.

SUMMARY OF THE INVENTION

The improved reel assembly is comprised of two identically molded semi-circular core halves having a pair of reel flanges on each end thereof The core halves and reel flanges are constructed and arranged to connect without the need for fasteners when forming the hose reel. The halves include a plurality of radially extending cross-braces having a conical cross-section. On opposite ends of the halves are included two radially extending tubular members having a hollow body and conical cross-section. Each half has opposite reciprocating cross-braces that interlock and opposite reciprocating tubular members that insert within each other to create a strong connection between the halves and a strong reel core. On the peripheral edge of each half is further included a plurality of tabs for interlocking with an opposite tab on the opposite half. The reel flanges are circularly shaped end pieces on the reel. Each reel flange has a cross-section larger than that of the reel. Each reel flange has an interlocking mechanism compatible with the reel halves which is comprised of L-shaped clips on the center hub that interlock with corresponding inverted L-shaped clips on the top and bottom edge of each reel half.

Accordingly, it is an objective of the instant invention to provide an improved reel assembly that resists crushing of the reel and separation between the reel halves from a pressurized hose being wound thereon.

It is a further objective of the instant invention to provide an improved reel assembly that doesn't require the use of tools or fasteners for maintenance purposes, so as to be less aggravating to the consumer during assembly and disassembly.

It is yet another objective of the instant invention to provide an improved reel assembly that reduces the likelihood of reel core damage due to the use of heavy rubber and kink resistant hoses that have recently become more popular.

It is a still further objective of the invention to provide an improved reel assembly having a stronger, more robust reel construction by establishing a stronger connection between reel halves and reel flanges.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
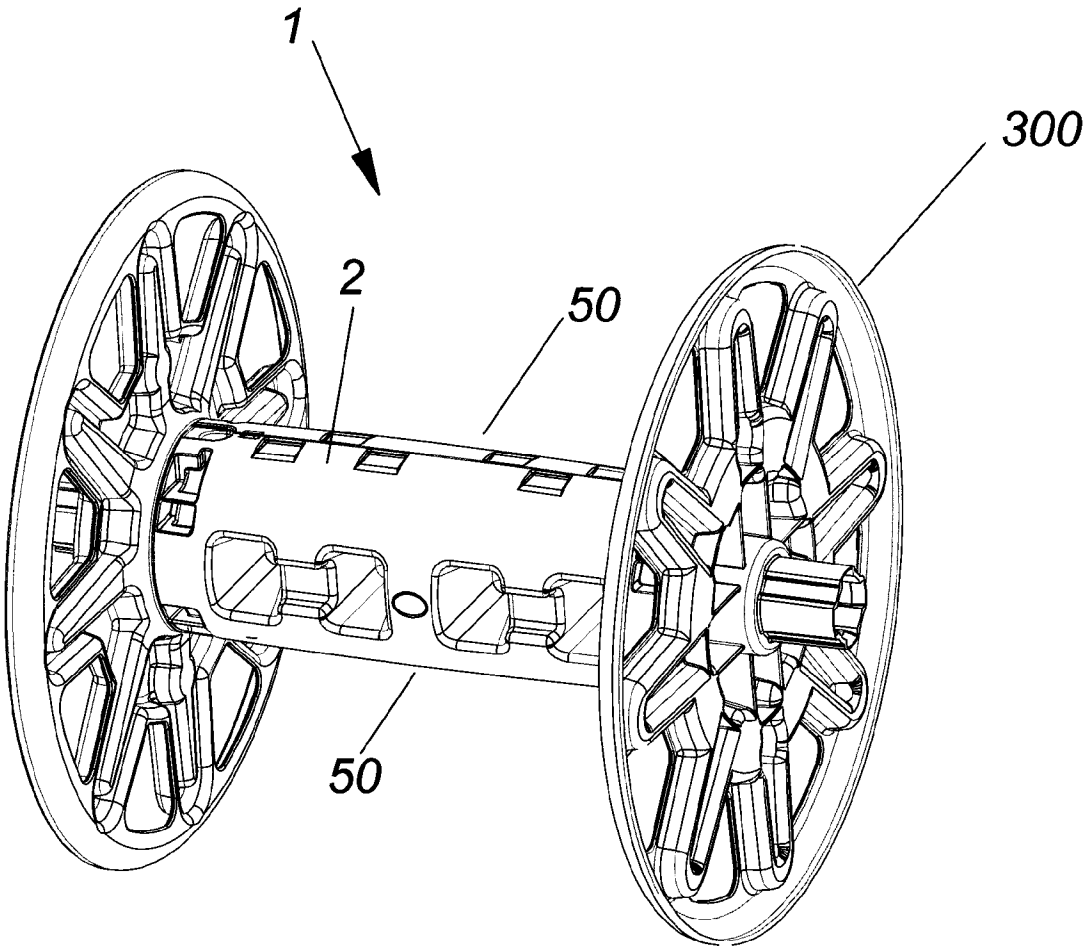
FIG. 1 is a perspective view of the improved reel assembly.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

As shown in FIG. 1, the reel assembly 1 is comprised of two molded semi-circular core halves 50 with a pair of reel flanges 300 on each end 52 of the half. The reel assembly 1 is by preference constructed of plastic by the process of injection molding, however other materials are contemplated. As shown in FIGS. 2-8, the core halves 50 and reel flanges 300 are constructed and arranged to connect without the need for fasteners in forming an improved reel assembly 1 for receipt of a flexible hose, not shown. The halves 50 include a plurality of radially extending cross-braces 100, each with a conical cross-section. On opposite ends 52 of each half is a pair of radially extending tubular members 250 having a hollow body 252 and conical cross-section. A receiving hollow body tubular member 252 inserts within a reciprocating tubular member 254 on the opposite half 50, more aptly shown in FIGS. 5-6. Each half 50 has a plurality of cross-braces 100 that interlock with an opposite reciprocating cross-brace 100 on the opposite half 50, more aptly shown in FIG. 4. The interlocking of the cross-braces 100 and insertion of tubular members 250 creates a strong connection between the halves 50 resulting in a strong reel core 2.

Figure 2:
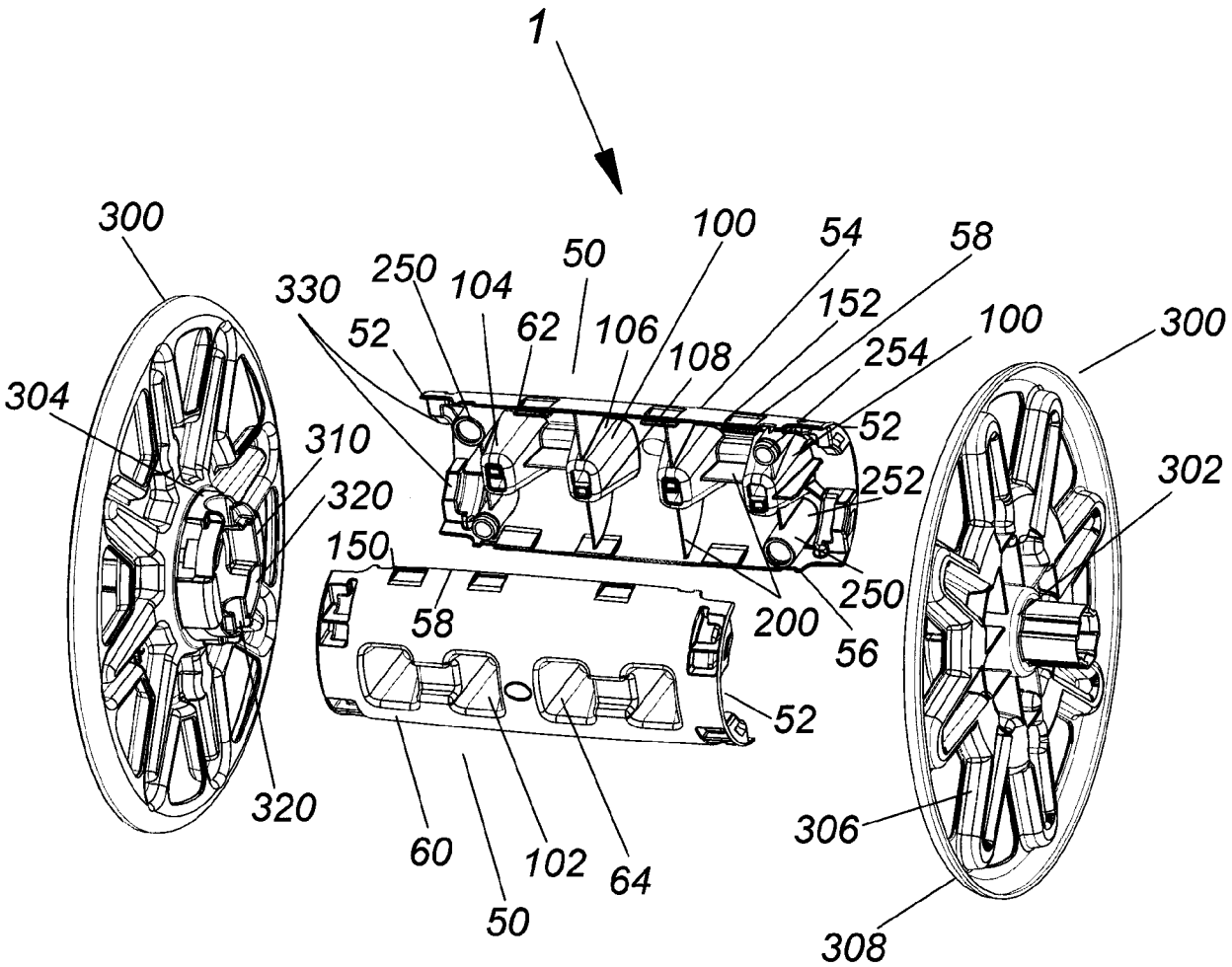
FIG. 2 is an exploded view of the improved reel assembly.
Figure 3:
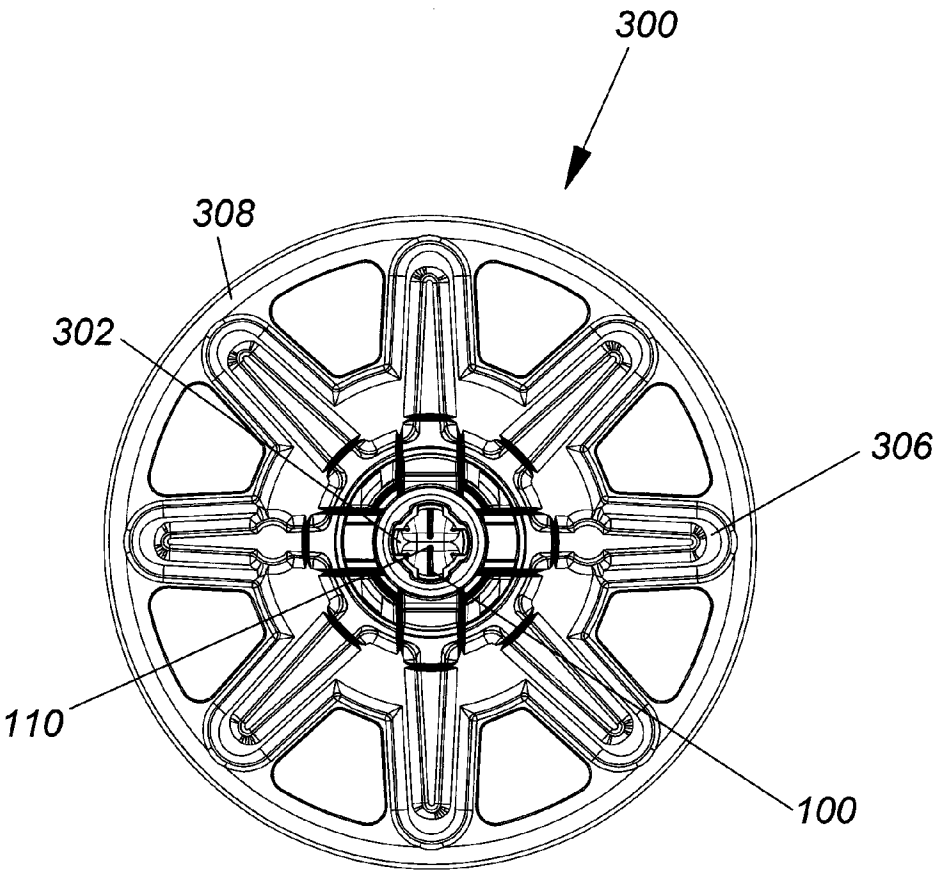
FIG. 3 is a side view of the improved reel assembly.
Figure 4:
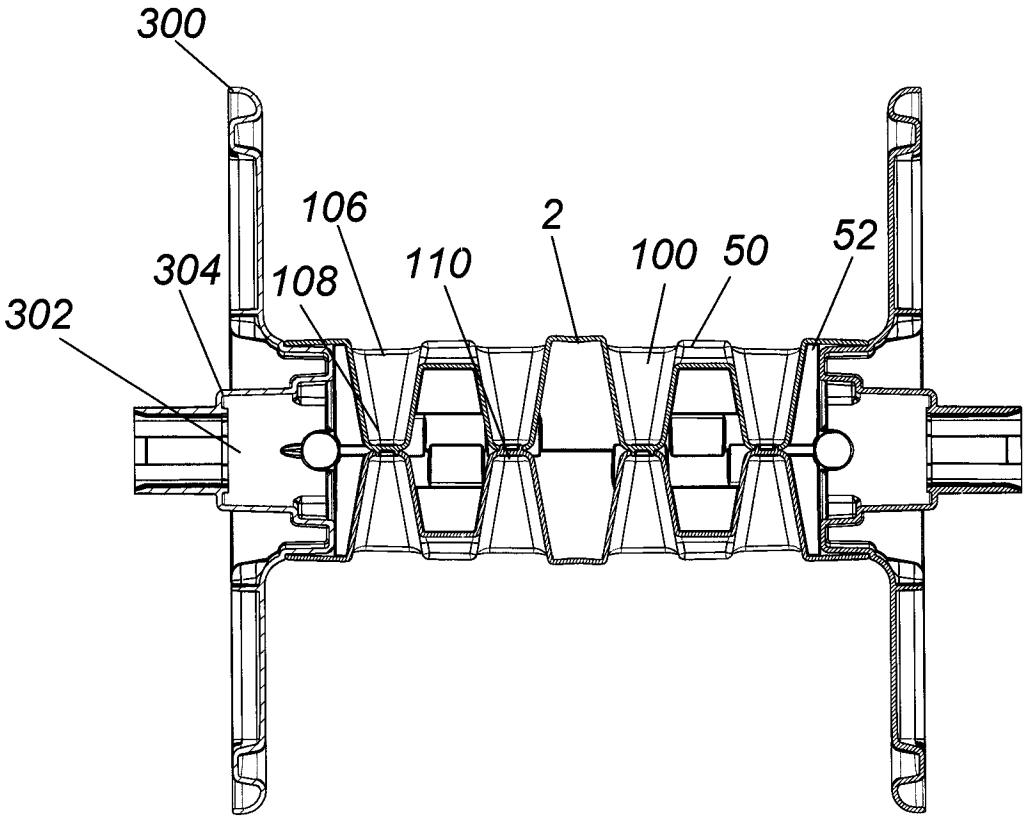
FIG. 4 is a cross-sectional side view of the improved reel assembly.
Figure 6:
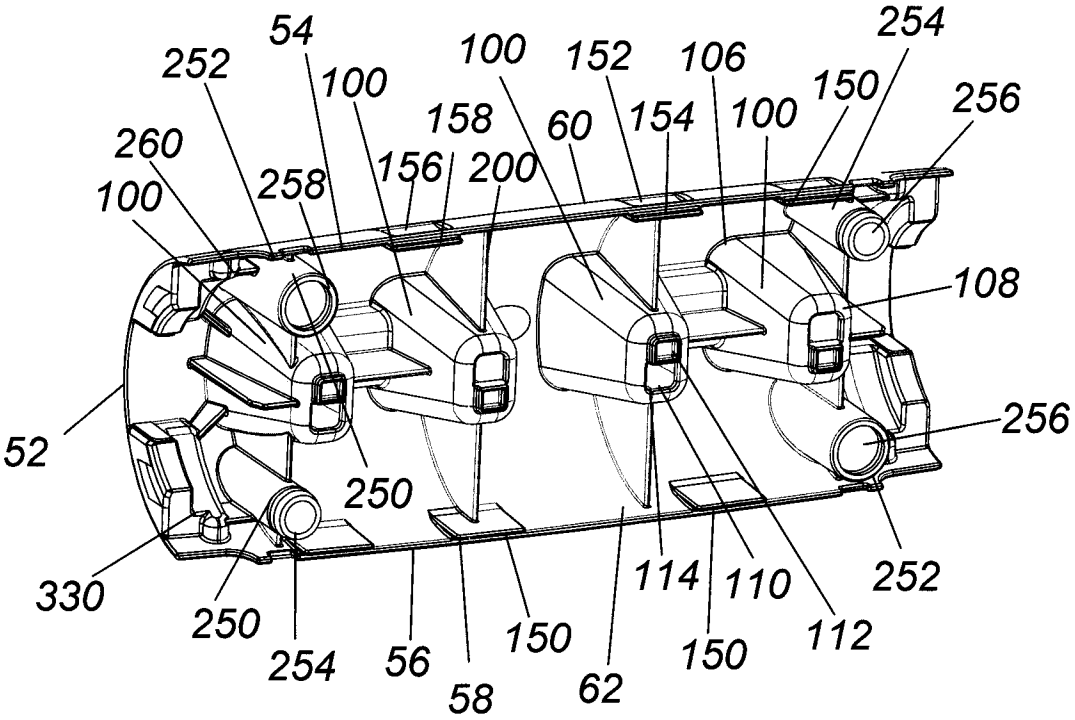
FIG. 6 is a perspective view of a reel half of the instant invention.

Also shown in FIGS. 2 and 6, a plurality of support members 200 are interspersed between cross-braces 100 as well as between cross-braces 100 and the top or bottom portions, 54 and 56, of each half 50. The support members 200 provide greater strength and integrity to the reel core structure 2. On the peripheral edge 58 of the top and bottom portion, 54 and 56, of each half 50 are a plurality of tabs 150. The tabs 150 interlock with an opposite receiving tab 152 on the opposite half 50. Each reel flange 300 is a circularly shaped end piece on the reel half 50. Each reel flange 300 has a cross-section larger than that of the reel 2. Each reel flange 300 has an interlocking mechanism 310 compatible with the reel halves 50. The interlocking mechanism 310 is comprised of L-shaped clips 320 on the center hub 302 of the reel flange 300 that interlock with corresponding inverted L-shaped clips 330 on the top edge 54 and bottom edge 56 of each reel half 50.

Figure 5:
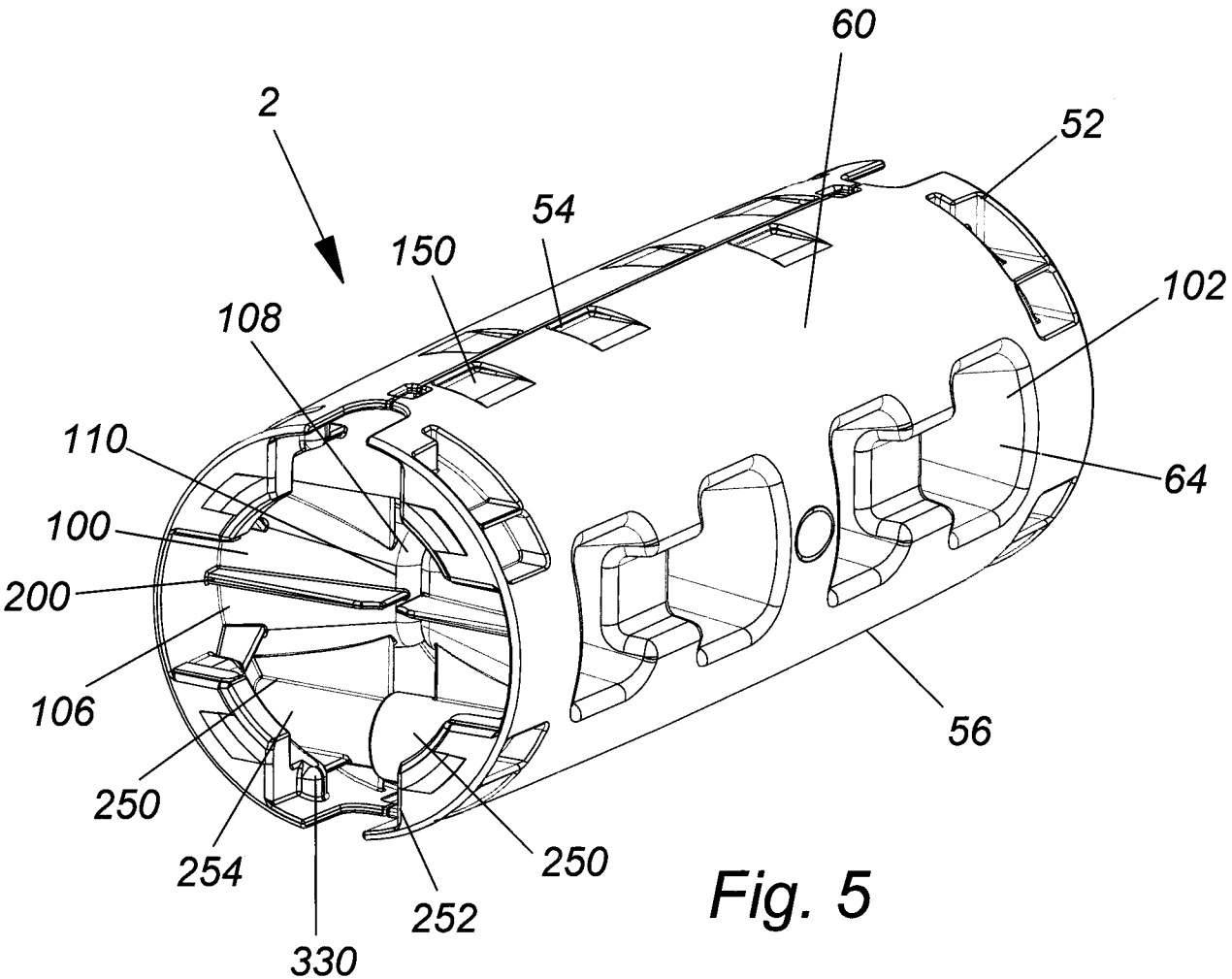
FIG. 5 is a side perspective view of the reel halves without the reel flanges of the instant invention.

FIGS. 5 and 6, show the reel halves 50 without the reel flange 300 attached. Each reel half 50 has an outer reel bearing surface 60 and an inner surface 62. The outer reel bearing surface 60 includes a plurality of openings 64 defined by the inner surface 102 of each cross-brace 100. However, it is contemplated that the outer reel bearing surface 60 can be smooth. The inner surface 62 of each half 50 includes a plurality of cross-braces 100, a pair of tubular members 250, support members 200, and inverted L-shaped clips 330. As shown, four cross-braces 100 are used in this construction, however, more or less are contemplated. Each radially extending cross-brace 100 has a conical cross-section. Each cross brace 100 is comprised of a first end 106 attached to the inner surface 62 of the half 50 and a second end 108, which extends radially no further than the perpendicular plane of the top and bottom peripheral edge 58 of the half 50. The first end 106 of the cross-brace 100 has a larger conical cross-section than that of the second end 108. The second end 108 includes a mating surface 110. The mating surface 110 is comprised of one protruding quadrilateral structure 112 and a second quadrilateral hollow receiving body 114. The protruding quadrilateral structure 112 has all four sides angled toward the center of the quadrilateral structure forming a taper on all four sides. The sides extend outwardly and the taper extends away from the inner surface 62 of the half 50. The quadrilateral receiving hollow body 114 is constructed and arranged to receive the protruding quadrilateral structure 112. The receiving quadrilateral body 114 is tapered inward toward the inner surface 62 of the half 50. When in use, the protruding quadrilateral structure 112 mates with the receiving body 114 making frictional contact on all four sides.

As shown in FIG. 6, each half 50 is comprised of a top and bottom portion, 54 and 56. Each top and bottom portion, 54 and 56, is terminated at a peripheral edge 58. The edge 58 includes a plurality of tabs 150 interspersed thereon. Each tab interlocks with an opposite receiving tab 152 on opposite half 50. The plurality of tabs 150 are comprised of alternating receiving tab portions 152 and extended tab portions 156. The receiving tab portion 152 has an opening 154 constructed and arranged to receive the extended tab portion 156. The extended tab portion 156 includes a projecting tip 158 sized to fit within the receiving tab portion 152 and remain in frictional contact therewith. As discussed earlier, the inner surface 62 of each half 50 further includes support members 200 between cross-braces 100, as well as between cross-braces 100 and the top and bottom portions, 54 and 56, of the half 50 to provide greater strength and integrity to the reel core structure 2. Additionally, on each end 52 of the inner surface 62 of each half 50 is a pair of tubular members 250 which extend out radially. Each tubular member 250 has a conical cross-section and a hollow shell 256. The first tubular member 252 has a distal end 258 with a cross-section larger than its proximal end 260, and the second tubular member 254 has a distal end 258 with a cross-section smaller than its proximal end 260 (proximal end is defined by the end closest to the inner surface of the half). The first tubular member 252 is sized to receive within its hollow shell 256 a second tubular member 254 on the opposite half 50; and the second tubular member 254 is sized to fit within the first tubular member 252 on the opposite half 50.

Figure 7:
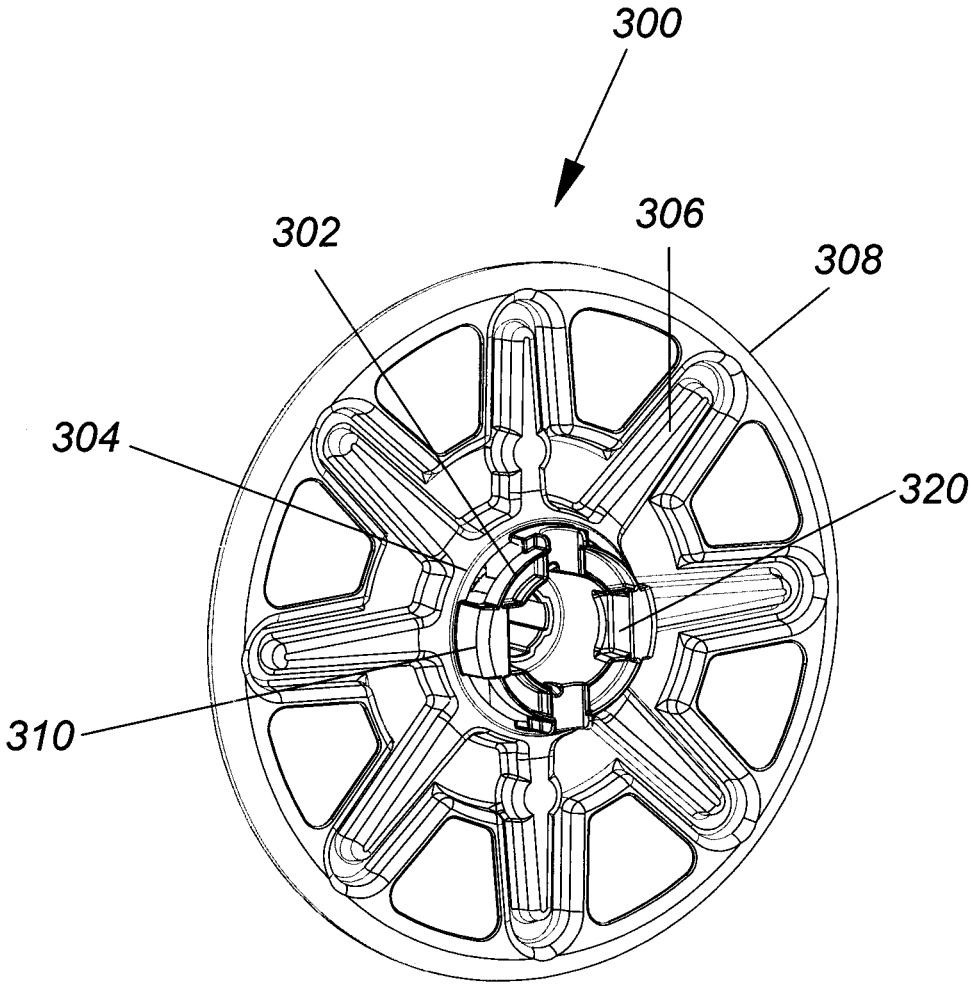
FIG. 7 is a side view of the reel flange of the instant invention.
Figure 8:
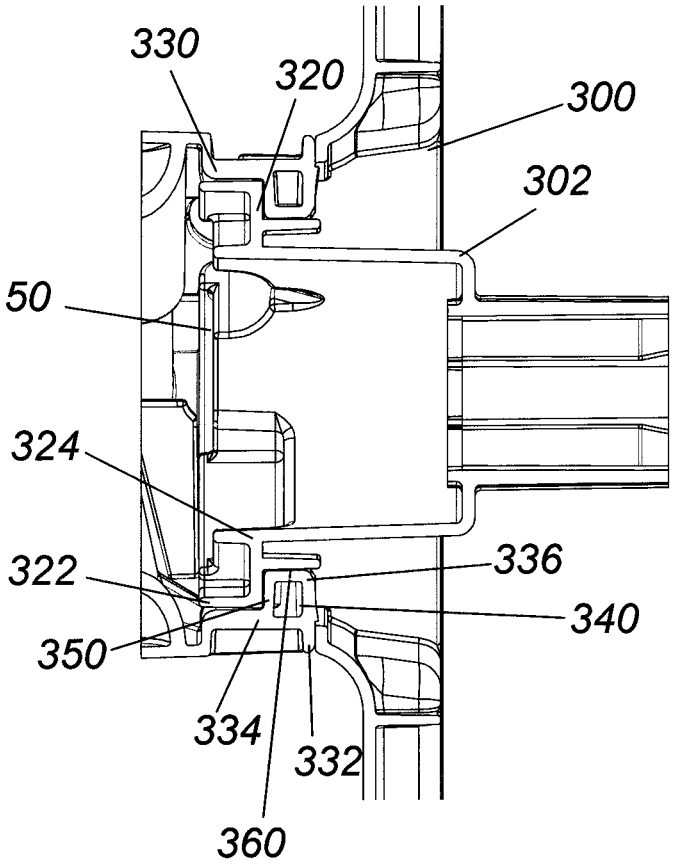
FIG. 8 is a cross-sectional view of the interlocking between reel flange and the reel halves of the instant invention.

FIGS. 7 and 8 show the reel flange 300. Each circularly-shaped reel flange 300 is placed on the ends 52 of the reel half 50. On the center of each flange 300 is a center hub 302, and extending from the top surface 304 of the center hub 302 is a plurality of spokes 306. The spokes 306 radiate to the larger hub 308 of the reel flange 300. The center hub 302 extends outwardly further than the larger hub 308 on each end, thereby having a larger width. Each reel flange 300 has an interlocking mechanism 310 with the reel half 50 in the form of L-shaped clips 320 on the reel flange 300 that interlock with corresponding inverted L-shaped clips 330 on the top and bottom ends, 54 and 56, of each half 50. There are three mating surfaces, 340, 350, and 360, between the reel half 50 and the reel flange 300, more aptly shown in FIG. 8. The first mating surface 340 is the center hub 302 on the flange 300 against a first portion on the inverted L-shaped clip 332 on the reel half 50. The first mating surface 340 prevents the flange 300 from moving inwardly towards the reel half 50. The second mating surface 350 is the first portion on the L-shaped clip 322 in the reel flange 300 against the second portion on the inverted L-shaped clip 334 on the reel half 50. The second mating surface 350 prevents the flange 300 from moving outwardly away from the reel half 50. The third mating surface 360 is the second portion on the L-shaped clip 324 on the reel flange 300 against a third portion on the inverted L-shaped clip 336 on the reel half 50. The third mating surface 360 prevents the flange 300 from moving in a direction away from the axis of rotation of the reel half 50.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An improved reel assembly comprising:

a pair of semi-circularly shaped core halves, each said half being constructed and arranged for releasable frictional engagement therewith to form a reel core;

a plurality of radially extending cross-braces on each said half, said plurality cross-braces extending from a inner surface on each said half and having a conical cross-section;

a pair of radially extending tubular members having a hollow body and conical cross-section on an opposite end of each said half, said pair of tubular members extending from said inner surface on each said half, whereby each said half has an opposite reciprocating interlocking cross-brace and an opposite reciprocating tubular member to create a strong connection between said halves forming said reel core; and a pair of reel flanges constructed and arranged to connect to said end of each said half, said flange is circularly shaped and includes an interlocking structure compatible with said reel core to form a hose reel.

2. The improved reel assembly of claim 1, is constructed of molded plastic.

3. The improved reel assembly of claim 1, wherein each said half has a top and bottom peripheral edge.

4. The improved reel assembly of claim 3, wherein along said edge is included a plurality of tabs and a corresponding plurality of receiving tabs, whereby said tabs on said half interlock with said receiving tabs on said opposite half.

5. The improved reel assembly of claim 2, wherein said cross-brace comprises of a first end attached to said inner surface of said half and a second end extending radially no further than the plane of said peripheral edge and including a mating surface.

6. The improved reel assembly of claim 5, wherein said mating surface has a first protruding quadrilateral structure and a second quadrilateral hollow receiving body, said first structure has four sides angled outwardly toward the center forming a uniform taper, and said second body has four sides angled inwardly towards the center.

7. The improved reel assembly of claim 6, wherein said second body is constructed and arranged to frictionally receive said first structure on said opposite reciprocating half, and said first structure is constructed and arranged to engage said second body on said opposite reciprocating half.

8. The improved reel assembly of claim 1, wherein said pair of tubular members comprises of a first and second tubular member.

9. The improved reel assembly of claim 8, wherein said first tubular member has a proximal and distal end, said distal end has cross-section larger than said proximal end.

10. The improved reel assembly of claim 9, wherein said second tubular member has proximal and distal end, said distal end has smaller cross-section than said proximal end.

11. The improved reel assembly of claim 10, wherein said first tubular member is sized to receive said second tubular on said opposite reciprocating half, said second tubular member is sized to fit within said first tubular member on said opposite reciprocating half.

12. The improved reel assembly of claim 1, wherein said reel flange is circularly shaped having a center hub, a plurality of spokes extending from said center hub and terminating in a larger hub.

13. The improved reel assembly of claim 12, wherein said center hub has a larger width than larger hub, and said center hub is sized to fit within said reel core.

14. The improved reel assembly of claim 13, wherein said interlocking structure comprises of a plurality of L-shaped clips on said center hub and a corresponding plurality of inverted L-shaped clips on said end of each said half.

* * * * *